United States Patent [19]

Andreini et al.

[11] Patent Number: 4,523,951

[45] Date of Patent: Jun. 18, 1985

[54] STAINLESS STEEL

[75] Inventors: Rockne J. Andreini; Audley J. Farmer; Svetlana Yaguchi, all of King County, Wash.

[73] Assignee: Earle M. Jorgensen Co., Seattle, Wash.

[21] Appl. No.: 553,373

[22] Filed: Nov. 21, 1983

Related U.S. Application Data

[63] Continuation of Ser. No. 449,608, Dec. 14, 1982, Pat. No. 4,450,008.

[51] Int. Cl.[3] ..... C22C 38/04

[52] U.S. Cl. ..... 75/126 B; 75/126 F; 75/128 A; 75/128 G

[58] Field of Search ..... 75/126 J, 126 F, 126 B, 75/128 A, 128 G, 128 N; 148/38, 137, 2, 12 E

[56] References Cited

U.S. PATENT DOCUMENTS

| | | | |
|---|---|---|---|
| 2,405,666 | 8/1946 | Norwood | 75/128 A |
| 4,000,984 | 1/1977 | Bäumel | 75/128 A |
| 4,162,930 | 7/1979 | Abe et al. | 148/38 |

FOREIGN PATENT DOCUMENTS

| | | | |
|---|---|---|---|
| 71360 | 4/1983 | Japan | 75/128 A |

OTHER PUBLICATIONS

Perry's Chemical Engineers' Handbook, 5th Ed., (1973), pp. 23-14 and 23-15.

Steiner et al., Metal Progress, Grain Boundary Carbides In Extra-Low-Carbon Stainless, 7-57, pp. 108-110.

*Primary Examiner*—L. Dewayne Rutledge
*Assistant Examiner*—Debbie Yee
*Attorney, Agent, or Firm*—Seed and Berry

[57] ABSTRACT

The present invention relates to a fully austenitic, non-magnetic stainless steel which maintains the carbon concentration of the final steel near the solubility limit for carbon in the steel and adds columbium in an amount sufficient to stabilize the steel by columbium's preferential scavenging of carbon over chromium. This preferential scavenging substantially eliminates chromium carbide formation at grain boundaries in the solid solution of the final stainless steel product. A highly preferred stainless steel consists essentially of, by weight:

16-20% Manganese,
12-15% Chromium,
5.0% Molybdenum max.,
2.5% Nickel max.,
1.0% Copper max.,
0.75% Silicon max.,
0.2-0.5% Nitrogen,
0.04% Phosphorus max.,
0.01% Sulfur max.,
0.035% Carbon max.,
Columbium at a concentration of at least ten times the Carbon concentration, and
the remainder being essentially Iron with incidental impurities.

13 Claims, No Drawings

STAINLESS STEEL

This application is a continuation of U.S. patent application Ser. No. 449,608, filed Dec. 14, 1982, now U.S. Pat. No. 4,450,008.

DESCRIPTION

1. Technical Field

The present invention relates to an austentic, nonmagnetic stainless steel which has improved resistance to stress corrosion cracking.

2. Background Art

In austenitic stainless steels, chromium carbide often forms at the grain boundaries within the solid steel at temperatures in the range of about 800°-1600° F. Working the steel in the range from 1000°-1300° F. is generally considered the worst conditions for chromium carbide formation at the grain boundaries (second phase formation). Whenever chromium carbide is formed, chromium necessary to maintain the steel as a stainless steel is depleted. In the area immediately adjacent to the boundary, this depletion is particularly harmful because an electrochemical cell is established within each grain. The material next to the grain boundary (called "chromium-poor material") is eventually consumed because this chromium-poor material becomes anodic relative to the remainder of the grain material, initiating pitting-type corrosion. Further consumption can lead to both inter- and transgranular cracking, if degradation is allowed to progress.

DISCLOSURE OF INVENTION

The present invention relates to a fully austenitic, nonmagnetic stainless steel. The preferred steel has improved resistance to stress corrosion cracking because the steel chemistry is controlled to limit the concentration of carbon available in the steel and to include excess columbium in an amount sufficient to stabilize the steel by having the columbium preferentially scavenge carbon over chromium. In this manner, columbium carbide preferentially forms rather than chromium carbide (which would be detrimental to the resistance of the steel). Substantially all chromium carbide formation at grain boundaries is eliminated by the inclusion of excess columbium (niobium) and by maintaining a low carbon concentration. In a preferred, fully austenitic, nonmagnetic stainless steel, the carbon content of the final steel should be no greater than 0.035% by weight of the melt, and columbium should be added to a concentration of at least ten times the carbon concentration to form a fully austenitic, nitrogen-bearing, manganese-substituted, nonmagnetic stainless steel having the following composition:

16-20% Manganese,
12-15% Chromium,
5.0% Molybdenum max.,
2.5% Nickel max.,
1.0% Copper max.,
0.75% Silicon max.,
0.2-0.5% Nitrogen,
0.04% Phosphorus max.,
0.01% Sulfur max.,
0.035% Carbon max.,
Columbium at a concentration of at least ten times the Carbon concentration, and
the remainder being essentially Iron with incidental impurities.

The nominal mechanical properties of this preferred steel are 110 KSI yield strength, 125 KSI tensile strength, 30% elongation, and 60% reduction of area (with 60-100 ft. lb. CVN energy at room temperature). These properties are obtained by working the steel during the later stages in the temperature range between about 1100°-1400° F.

This steel uses manganese substitution for nickel in the basic composition and relies on nitrogen strengthening and carbon stabilization to achieve its overall mechanical/chemical properties. Because the steel is fully austenitic, it cannot be hardened by common heat treatment procedures, but must be hardened instead by "working" (forming). The ultimate strength of the alloy is principally determined by nitrogen strengthening (due to solid solubility), which is dependent upon the degree of work and the temperature of the material during working.

Maintaining the carbon content within the alloy as low as possible, plus the addition of columbium at a minimum of ten times the carbon content, effectively inhibits chromium carbide formation at grain boundaries. Improved corrosion resistance is achieved because the carbon content is near the solubility limit of carbon in the alloy, thereby reducing the tendency for second phase formation, and columbium is present to ensure that columbium rather than chromium carbide forms. The columbium carbide is distributed uniformly throughout the material, thereby minimizing second phase formation at the grain boundaries and eliminating the electrochemical problems of the prior art. This special carbon/columbium stainless steel greatly improves the chemical resistance of the material to corrosion, particularly corrosion associated with grain boundary networks of chromium carbide precipitates (commonly called "sensitized materials").

BEST MODE FOR CARRYING OUT THE INVENTION

Stress corrosion cracking has been a long-standing and persistent problem of steels, particularly fully austenitic, nonmagnetic stainless steels of the type described in this invention. By carefully controlling the concentration of carbon within the melt and the ratio of columbium to carbon, it has been found that substantially improved resistance to stress corrosion cracking may be obtained. Therefore, it is particularly desirable to make fully austentic, nonmagnetic stainless steel consisting essentially of, by weight:

16-20% Manganese,
12-15% Chromium,
5.0% Molybdenum max.,
2.5% Nickel max.,
1.0% Copper max.,
0.75% Silicon max.,
0.2-0.5% Nitrogen,
0.04% Phosphorus max.,
0.01% Sulfur max.,
0.035% Carbon max.,
Columbium at a concentration of at least ten times the Carbon concentration, and
the remainder being essentially Iron with incidental impurities.

This steel avoids the formation of problematic chromium carbide at grain boundaries within the solid solution of the steel and may be worked in the temperature range of between 1100°-1400° F. to produce a steel with nominal mechanical properties of 110 KSI yield strength, 125 KSI tensile strength, 30% elongation, and 60% reduction of area (with 60–100 ft. lb. CVN energy at room temperature).

Manganese is added to the melt as a low-cost substitute for nickel and is necessary to provide a fully austenitic structure in the final stainless steel. Chromium is added to make the stainless steel. It is desirable to provide sufficient chromium to ensure that the final steel will be a stainless steel while minimizing the amount of chromium available for formation of chromium carbides. Therefore, the range of 12–15% chromium is particularly desirable in that it satisfies both constraints. Molybdenum, nickel, and copper are added to enhance corrosion resistance of the final steel. Silicon and nitrogen are added to improve the strength of the final product. Phosphorus and sulfur are rigidly controlled to enhance overall product quality.

The carbon concentration is quite low compared to typical, fully austenitic, nonmagnetic stainless steels and is limited so that the concentration of carbon in the final steel is near or substantially at the solubility limit of carbon in the final steel. At this concentration, the carbon tends to stay in solution rather than to combine with other metals in the steel. To substantially eliminate the formation of chromium carbide at grain boundaries in the solid solution of the final steel, columbium (niobium) is added to the melt in an amount sufficient to stabilize the steel by having columbium preferentially scavenge carbon over chromium. In this manner, columbium carbide forms and is distributed uniformly throughout the steel rather than chromium carbide, which is distributed essentially at the grain boundaries. The electrochemical cell phenomenon which leads to pitting-type corrosion and inter- and transgranular cracking is virtually eliminated by the addition of sufficient columbium. Thermodynamically, it is necessary to add between about five to eight times the carbon concentration of columbium, by weight, to provide the essential chromium carbide elimination. To ensure that adequate columbium is available for carbide formation and that extra columbium is available for enhancing the properties of the final steel, it is desirable and highly preferred to add a minimum of ten times the carbon concentration of columbium to the steel.

While others have tried to reduce the carbon concentration and have added columbium to stabilize stainless steels, to the knowledge of the inventors, no one has found the critical relationship between the concentrations of carbon and columbium in a fully austenitic, nitrogen-bearing, manganese-substituted nonmagnetic stainless steel. Therefore, the general concept of this invention is to maintain the carbon concentration of the steel near the solubility limit for carbon in the steel while adding columbium in an amount sufficient to stabilize the nitrogen-bearing steel by columbium's preferential scavenging of carbon over chromium in the stainless steel product. This preferential scavenging substantially eliminates chromium carbide formation at grain boundaries. Those skilled in the art will readily recognize the desirable methods for manufacturing steels of this quality, with such melt processing usually being conducted in an argon/oxygen decarburization vessel.

EXAMPLE 1

NMS-100 steel of Earle M. Jorgensen Co. having an analysis within the ranges indicated for the preferred steel of this invention was tested to show the susceptibility of intergranular corrosion through ASTM tests A262A and A262E under standard conditions. Each sample was initially sensitized with heat treatments at about 1200° F. for 1–2 hours. When examined under the microscope, the samples passed both A262A and A262E, there being no cracks visible in the samples at low magnification. This steel had a low carbon concentration near the solubility of carbon in the solid solution of the alloy, and the columbium concentration was at least ten times the carbon concentration, by weight. The steel was fully austenitic, nonmagnetic, and fully stabilized.

We claim:

1. A fully austenitic, substantially nonmagnetic stainless steel, comprising:

a stainless steel alloy of Iron including Manganese, Chromium, Molybdenum, Nickel, and Nitrogen to make the steel fully austenitic and substantially nonmagnetic;

0.035% max. Carbon, by weight, in the alloy; and

Columbium in the alloy at a concentration of at least ten times the Carbon concentration;

wherein the concentration of Nitrogen is between 0.2–0.5%, by weight, to provide Nitrogen strengthening to the steel through working the steel at a temperature in the range between about 1100°–1400° F., and wherein the concentration, by weight, of the Manganese is between about 16–20%; of the Chromium is between about 12–15; and of the Nickel is no greater than 2.5%.

2. The steel of claim 1 wherein the concentration of Molybdenum is no greater than 5.0% by weight.

3. The steel of claim 2 wherein the steel has a yield strength of about 110 KSI, a tensile strength of about 125 KSI, an elongation to break of about 30%, and a reduction of area of about 60% (with 60–100 ft. lb. CVN energy at room temperature) when worked at a temperature range of between 1100°–1400° F.

4. The steel of claim 1, further comprising, by weight, no greater than 1.0% Copper, no greater than about 0.04% Phosphorus, and no greater than about 0.01% Sulfur.

5. An austenitic, nonmagnetic stainless steel comprising:

a Nitrogen-Manganese-Chromium stainless steel alloy of Iron exhibiting fully austenitic structure and being substantially nonmagnetic, including a level of Columbium at a concentration high enough to substantially eliminate the formation of Chromium Carbide at grain boundaries within the solid alloy so that the alloy has improved resistance to stress corrosion cracking, wherein the alloy includes Carbon at a concentration near the solubility limit for Carbon in the solid alloy, wherein the Columbium concentration is about ten times the Carbon concentration, by weight, wherein the concentration of Nitrogen is between about 0.2–0.5%., by weight, to provide Nitrogen strengthening to the steel through working the steel at a temperature in the range between about 1100°–1400° F., and wherein the concentration Chromium is less than about 15%, by weight, and the concentration of Manganese is at least about 16%, by weight.

6. An austenitic, nonmagnetic, Manganese-substituted Nickel, stainless steel comprising:

a fully austenitic, substantially nonmagnetic, chromium stainless steel alloy of Iron;

Carbon in the alloy at a concentration near the solubility limit for Carbon in the alloy;

Columbium in the alloy at a sufficient concentration to stabilize the alloy by preferentially scavenging Carbon to substantially eliminate Chromium Carbide formation at grain boundaries, the Columbium concentration being at least eight times the Carbon concentration;

Nitrogen in the alloy at a concentration of between about 0.2–0.5%, by weight, to provide Nitrogen strengthening for the steel through working the steel at a temperature between about 1100°–1400° F.; and a ratio of Manganese/Nickel of at least about 16/2.5.

7. An austenitic, nonmagnetic stainless steel comprising:

a fully austenitic, substantially nonmagnetic, Chromium stainless steel alloy of Iron;

carbon in the alloy at a concentration near the solubility limit for Carbon in the alloy; and Columbium in the alloy at a sufficient concentration to stabilize the alloy by preferentially scavenging Carbon to substantially eliminate Chromium Carbide formation at grain boundaries, the Columbium concentration being at least ten times the Carbon concentration, including, by weight:

16–20% Manganese,
12–15% Chromium,
5.0% Molybdenum max.,
2.5% Nickel max.,
1.0% Copper max., and
0.2–0.5% Nitrogen.

8. The steel of claim 7, including, by weight:

0.75% Silicon max.,
0.04% Phosphorus max.,
0.01% Sulfur max., and
0.035% Carbon max., the remainder being essentially Iron with incidental impurities.

9. The steel of claim 8 wherein the steel has a yield strength of about 110 KSI, a tensile strength of about 125 KSI, an elongation to break of about 30%, and a reduction of arez of about 60% (with 60–100 ft. lb. CVN energy at room temperature) when worked at a temperature range of between about 1100°–1400° F.

10. A method for making a fully austenitic, nonmagnetic, Chromium stainless steel, comprising the steps of:

maintaining the Carbon concentration of the steel near the solubility limit for Carbon in the steel, wherein the Carbon concentration is less than about 0.035 wt %;

adding Columbium to the steel in an amount sufficient to stabilize the steel by Columbium's preferential scavenging of Carbon over Chromium to substantially eliminate Chromium Carbide formation at grain boundaries in the solid solution of the steel, wherein the Columbium concentration is at least in slight excess of eight times the Carbon concentration;

adding Nitrogen to the steel in an amount sufficient to provide Nitrogen strengthening of the steel through working of the steel at a temperature in the range between about 1100°–1400° F., the Nitrogen concentration being between about 0.2–0.5 wt %; and substituting Manganese for Nickel in the steel to provide a low-Nickel, fully austenitic steel, the Nickel concentration being no greater than about 2.5 wt % and the Manganese concentration being at least about 16 wt %.

11. A fully austenitic, Nitrogen-bearing, Manganese-substituted, nonmagnetic stainless steel, comprising:

16–20 wt % Manganese;
12–15 wt % Chromium;
2.5 wt % Nickel max.,
0.035 wt % Carbon max.;
0.2–0.5 wt % Nitrogen; and Columbium in excess of eight times the Carbon concentration to eliminate Chromium Carbide formation and; thereby, to stabilize the austenitic steel, wherein the steel has nominal mechanical properties of about 110 KSI yield strength, 125 KSI tensile strength, a 30% elongation, and 60% reduction of area (with 60–100 ft lb CVN energy at room temperature).

12. The austenitic steel of claim 11, further comprising 5.0 wt % Molybdenum max.

13. The austenitic steel of claim 12, further comprising 1.0 wt % Copper max.

* * * * *